US009179747B2

(12) United States Patent
Marin

(10) Patent No.: US 9,179,747 B2
(45) Date of Patent: Nov. 10, 2015

(54) CLUTCH CASE WITH INTEGRAL LUMENS FOR CONTAINING LIQUID WITH ENTRAINED DECORATIVE MATERIAL

(71) Applicant: Fiona Kotur Marin, New York, NY (US)

(72) Inventor: Fiona Kotur Marin, New York, NY (US)

( * ) Notice: Subject to any disclaimer, the term of this patent is extended or adjusted under 35 U.S.C. 154(b) by 0 days.

(21) Appl. No.: 13/889,110

(22) Filed: May 7, 2013

(65) Prior Publication Data

US 2013/0299051 A1 Nov. 14, 2013

Related U.S. Application Data

(60) Provisional application No. 61/644,412, filed on May 8, 2012.

(51) Int. Cl.

| | |
|---|---|
| ***B65D 69/00*** | (2006.01) |
| ***A45C 1/02*** | (2006.01) |
| ***A45C 13/08*** | (2006.01) |

(52) U.S. Cl.

CPC .. *A45C 1/02* (2013.01); *A45C 13/08* (2013.01)

(58) Field of Classification Search

CPC ..... A45C 3/06; A45C 13/08; A45C 3/08; A45C 13/02; A45C 1/024

USPC ..... 150/100, 103, 104, 106, 107, 108, 150/112–118, 121, 126, 129, 134, 138, 150/150; 190/18 A, 110; 206/232, 581; 220/62.15; 362/156, 84; 40/124.01, 40/124.06, 124.12, 410, 725; 446/179, 446/267, 74; 473/570

See application file for complete search history.

(56) References Cited

U.S. PATENT DOCUMENTS

| | | | | | |
|---|---|---|---|---|---|
| 1,764,806 | A * | 6/1930 | Saccoccia | 292/128 |
| 2,288,996 | A * | 7/1942 | Dubilier | 150/150 |
| 2,484,661 | A * | 10/1949 | Vogel | 40/725 |
| 2,604,133 | A * | 7/1952 | Knee | 150/106 |
| 4,926,296 | A * | 5/1990 | Blume et al. | 362/156 |
| 5,261,848 | A * | 11/1993 | Kaplan et al. | 446/74 |
| 5,353,487 | A * | 10/1994 | Choh et al. | 28/204 |
| 5,442,869 | A * | 8/1995 | McDarren et al. | 40/406 |
| 5,718,336 | A * | 2/1998 | Haarlander | 206/542 |
| 5,913,442 | A * | 6/1999 | Wu | 220/62.15 |
| 2003/0000984 | A1 * | 1/2003 | Vick, III | 224/610 |
| 2008/0087360 | A1 * | 4/2008 | Duke | 150/104 |
| 2013/0048457 | A1 * | 2/2013 | Sbordoni | 190/18 A |

FOREIGN PATENT DOCUMENTS

DE 102995047245 A1 3/2007

OTHER PUBLICATIONS

International Preliminary Report on Patentability issued on Nov. 11, 2014 in connection with International Application PCT/US2013/040006.

(Continued)

*Primary Examiner* — Fenn Mathew
*Assistant Examiner* — Cynthia Collado
(74) *Attorney, Agent, or Firm* — Corridor Law Group, P.C.

(57) ABSTRACT

A clutch case comprises a pair of clamshell members hinged together at a bottom edge thereof such that the members, when closed, form an interior chamber for containing objects and, when open, provide access to the interior chamber. Each of the clamshell members has a lumen extending along at least a portion of its perimeter. The lumen is capable of containing a liquid having decorative material entrained therein. In use, tilting the case imparts motion to the entrained decorative material to create a unique visual appearance.

16 Claims, 5 Drawing Sheets

(56) References Cited

OTHER PUBLICATIONS

Anya Hindmarch, Marano Eye Twister Snow Globe Clutch (http://us.anyahindmarch.com/Evening-Bags/Marano-Eye-Twister-Snow-Globe-Clutch/Black-and-White-5050925766999.html?start=18).

International Search Report and Written Opinion of the International Searching Authority (European Patent Office) issued on Nov. 25, 2013, in connection with International Application No. PCT/US2013/040006.

* cited by examiner 46
44
40
42
10
22
22a
12
12a
17
11
21

3
10
40
12
11
12a
12b
3

40
10
46
42
44
14
12
16
24
22
26
28
18
17
21
11

CLUTCH CASE WITH INTEGRAL LUMENS FOR CONTAINING LIQUID WITH ENTRAINED DECORATIVE MATERIAL

CROSS-REFERENCE TO RELATED APPLICATION

This application is a related to and claims priority benefits from U.S. Provisional Patent Application Ser. No. 61/644,412, filed on May 8, 2012, entitled "Clutch Case With Integral Lumens For Containing Liquid With Entrained Decorative Material". The '412 provisional application is hereby incorporated by reference herein in its entirety.

FIELD OF INVENTION

The present invention relates to fashion accessories. In particular, the present invention relates to a clutch case, otherwise known as a minaudiere, for containing cosmetics or other personal objects, and is intended to be carried as a handbag.

BACKGROUND OF THE INVENTION

Fashion accessories are a form of personal expression. In the case of handbags, not only must the piece serve the functional purpose of containing and conveniently transporting personal items such as cosmetics and credit card holders, but the piece will also convey an impression about the person who carries it.

Unlike conventional handbags, which are static in appearance, the present clutch case has a unique, dynamic exterior appearance by virtue of a quantity of liquid contained within the handbag itself. The liquid stream can carry one or more types of decorative material, or two or more liquids of differing viscosities, to create an image of movement and flow that complements the clothing and other accessories worn by the person carrying the clutch case.

SUMMARY OF THE INVENTION

A clutch case comprises a pair of clamshell members hinged together at a bottom edge thereof such that the members when closed form an interior chamber for containing objects and when open provide access to the interior chamber. Each of the clamshell members has a lumen extending along at least a portion of its perimeter. The lumen is capable of containing a liquid having decorative material entrained therein such that tilting the case imparts motion to the entrained decorative material to create a unique visual appearance.

The clutch case can further include a clasp for retaining the clamshell members in a joined position such that the objects are securely retained within the interior chamber. The clasp is preferably mounted on one of the clamshell members by a hinge, and is detachably securable to a retaining member mounted on the other of the clamshell members. The clasp is preferably maintained in a normally closed position by a resilient member interposed between the clasp and the one of the clamshell members. The preferred resilient member is a spring.

In another embodiment, each of the clamshell members comprises a major planar surface and at least one side wall extending perpendicularly from the surface toward the other of the clamshell members. At least one solid bar preferably extends between portions of the at least one side wall to divide the interior chamber into a plurality of minor interior chambers. The at least one solid bar preferably interrupts the lumen to define a plurality of minor lumens. Each of the minor lumens is capable of containing a liquid having different decorative materials entrained therein.

In another embodiment, the clamshell members are formed from a transparent material. The interior chamber of this transparent embodiment can accommodate an image mounted therein such that the image is viewable from the exterior of the clutch case. The image can be a photograph. The image can be press-fitted in the interior chamber.

The decorative material within each lumen can comprise solid particles. The solid particles can be colored such that the particles are contrasting in appearance with objects contained within the interior chamber. The solid particles can be colored white such that motion imparted to the particles creates a snowglobe-like appearance.

The decorative material can also comprise a fluid having a viscosity different from that of the liquid, and the fluid can be colored such that the fluid contrasts in appearance with the liquid and when coagulated creates a lava-like appearance.

DETAILED DESCRIPTION OF PREFERRED EMBODIMENT(S)

Figure 1:
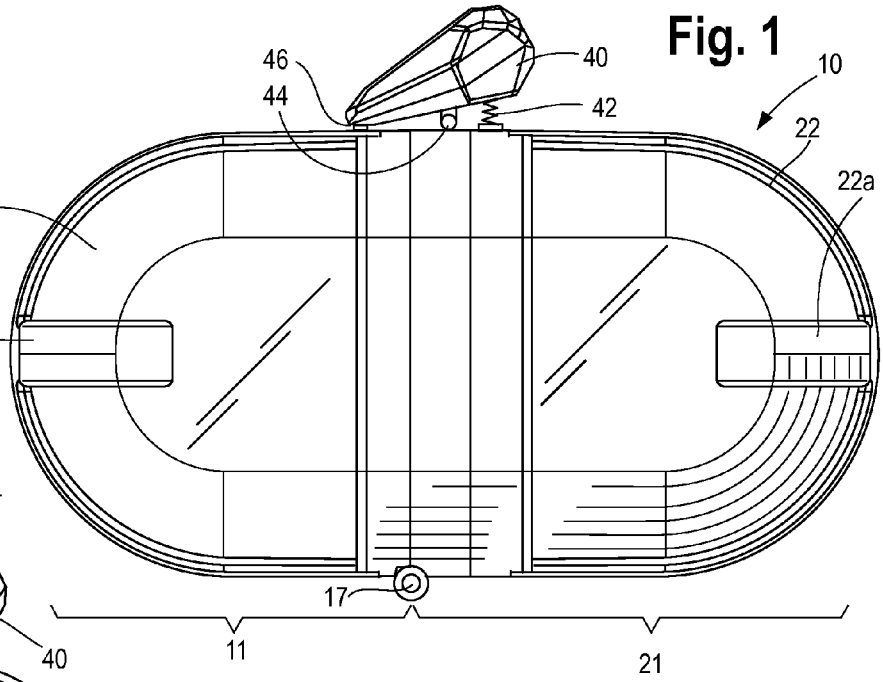
FIG. 1 is a front view of a preferred embodiment of a clutch case with integral lumens for containing a liquid with entrained decorative material.

Turning first to FIG. 1, a preferred embodiment of a clutch case 10 includes a pair of clamshell members 11, 21 hinged together at a bottom edge thereof by hinge 17. Clamshell member 11 includes an exterior shell 12 having optional design features formed on its exterior surface, one of which is shown in FIG. 1 as beveled portion 12*a*. Similarly, clamshell member 21 includes an exterior shell 22 having optional design features formed on its exterior surface, one of which is shown in FIG. 1 as beveled portion 22*a*.

When clutch case 10 is in the closed position shown in FIG. 1, clamshell members 11, 21 are retained in the closed position by a clasp 40. In the illustrated embodiment, clasp 40 has a plurality of beveled or faceted surfaces such that clasp 40 resembles a jewel or precious stone. A clasp hinge 44 secures clasp 40 to exterior shell 22 and facilitates pivotal movement of clasp 40 about hinge 44. Spring 42 interposed between clasp 40 and exterior shell 22 maintains clasp 40 in a normally closed position. A cooperating clasp retaining member 46 on exterior surface 12 detachably secures clasp 40 to permit clamshells 11, 21 to be opened apart when clasp 40 is lifted from retaining member 46 or closed together when clasp 40 is attached to retaining member 46.

Figure 2:
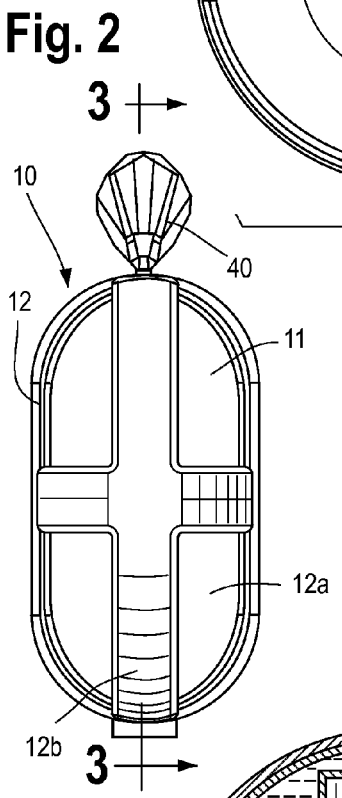
FIG. 2 is an end view of the clutch case with integral lumens illustrated in FIG. 1.

In FIG. 2, an end view of clutch case 10 shows clamshell member 11, which includes an exterior shell 12 having optional design features formed on its exterior surface, two of which is shown in FIG. 2 as beveled portions 12*a*, 12*b*.

Figure 3:
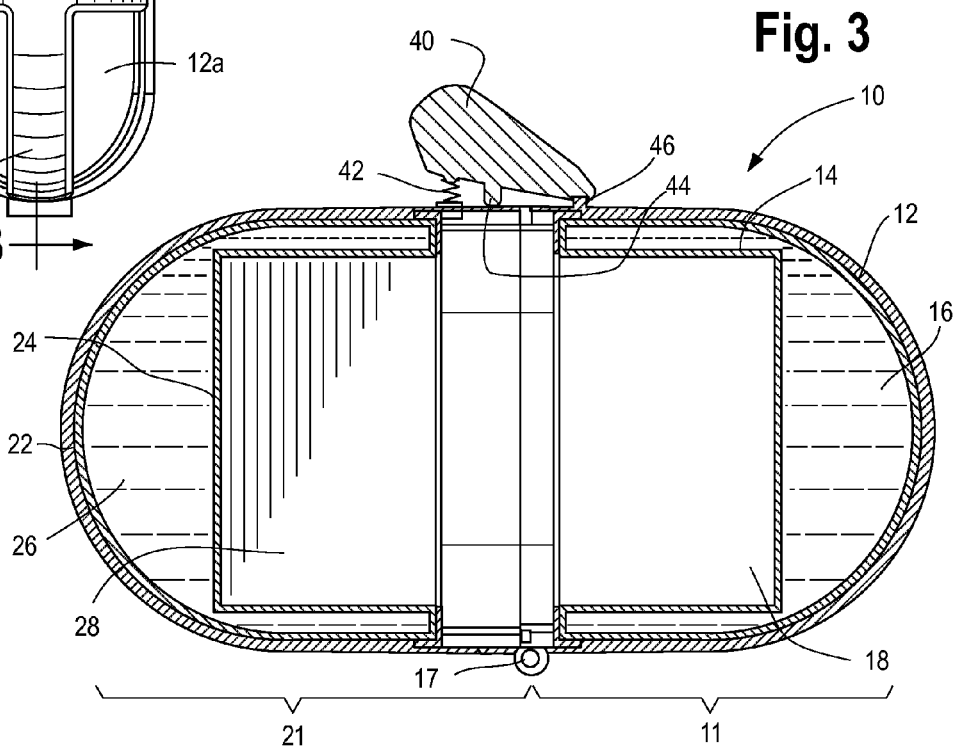
FIG. 3 is a front sectional view of the clutch case with integral lumens, taken in the direction of arrows 3-3 in FIG. 2.

FIG. 3 is a front sectional view of clutch case 10, taken in the direction of arrows 3-3 in FIG. 2. As shown, clutch case 10 includes a pair of clamshell members 11, 21 hinged together at a bottom edge thereof by hinge 17. Clamshell member 11 includes an exterior shell 12. Clamshell member 21 includes an exterior surface 22.

As further shown in FIG. 3, clamshell member 11 includes an interior shell 14 configured such that a lumen 16 is formed between exterior shell 12 and interior shell 14. A space 18 is defined at the interior side of interior shell 14. Similarly, clamshell member 21 includes an interior shell 24 configured such that a lumen 26 is formed between exterior shell 22 and interior shell 24. A space 28 is defined at the interior side of interior shell 24.

Lumens 16, 26 extend along at least a portion of the perimeter of each of clamshell members 11, 21. Lumens 16, 26 are capable of containing a liquid having decorative material entrained therein.

When closed, clamshell members 11, 21 form an interior chamber or compartment defined by the combined spaces 18, 28. The interior compartment can receive and securely contain personal objects or items such as keys, cosmetics, a wallet, credit cards, and the like.

As in FIG. 1, clamshell members 11, 21 are retained in the closed position by a clasp 40, pivotally mounted on exterior shell 22 by hinge 44. Spring 42 maintains clasp 40 in a normally closed position, and cooperating clasp retaining member 46 on exterior surface 12 detachably secures clasp 40 to permit clamshells 11, 21 to be opened apart when clasp 40 is lifted from retaining member 46 or closed together when clasp 40 is attached to retaining member 46.

Figure 4:
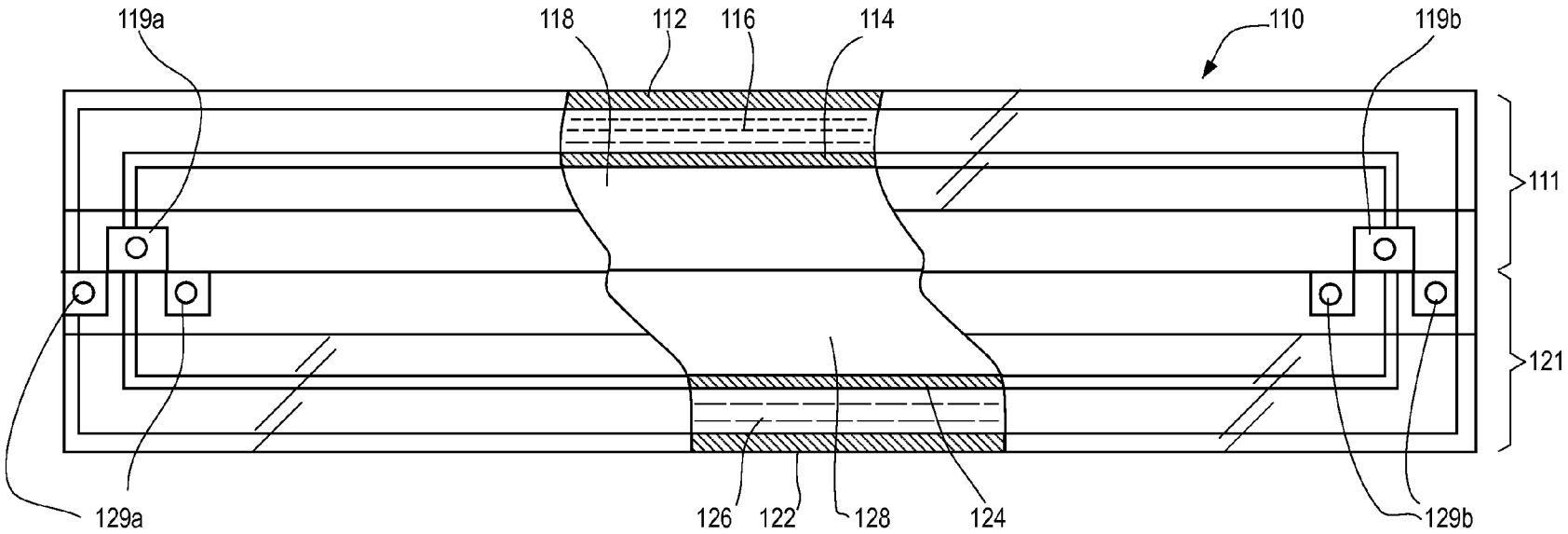
FIG. 4 is a bottom view, partially in cross-section, of a second embodiment of a clutch case with integral lumens, shown in the closed position.

Turning next to FIG. 4, a second embodiment of a clutch case 110 includes a pair of clamshell members 111, 121 hinged together at a bottom edge thereof. Clamshell member 111 includes an exterior shell 112 and an interior shell 114 configured such that a lumen 116 is formed between exterior shell 112 and interior shell 114. A space 118 is defined at the interior side of interior shell 114.

Similarly, clamshell member 121 includes an exterior shell 122 and an interior shell 124 configured such that a lumen 126 is formed between exterior shell 122 and interior shell 124. A space 128 is defined at the interior side of interior shell 124. Clamshell members 111, 121 are hinged together by cooperating hinge tabs 119*a*, 129*a* and 119*b*, 129*b*, which each have a pin (not shown) extending through the tabs.

When closed, clamshell members 111, 121 form an interior chamber or compartment defined by the combined spaces 118, 128. The interior compartment can receive and securely contain personal objects or items such as keys, cosmetics, a wallet, credit cards, and the like.

As further shown in FIG. 4, lumens 116, 126 extend along at least a portion of the perimeter of each of clamshell members 111, 121. Lumens 116, 126 are capable of containing a liquid having decorative material entrained therein.

Figure 5:
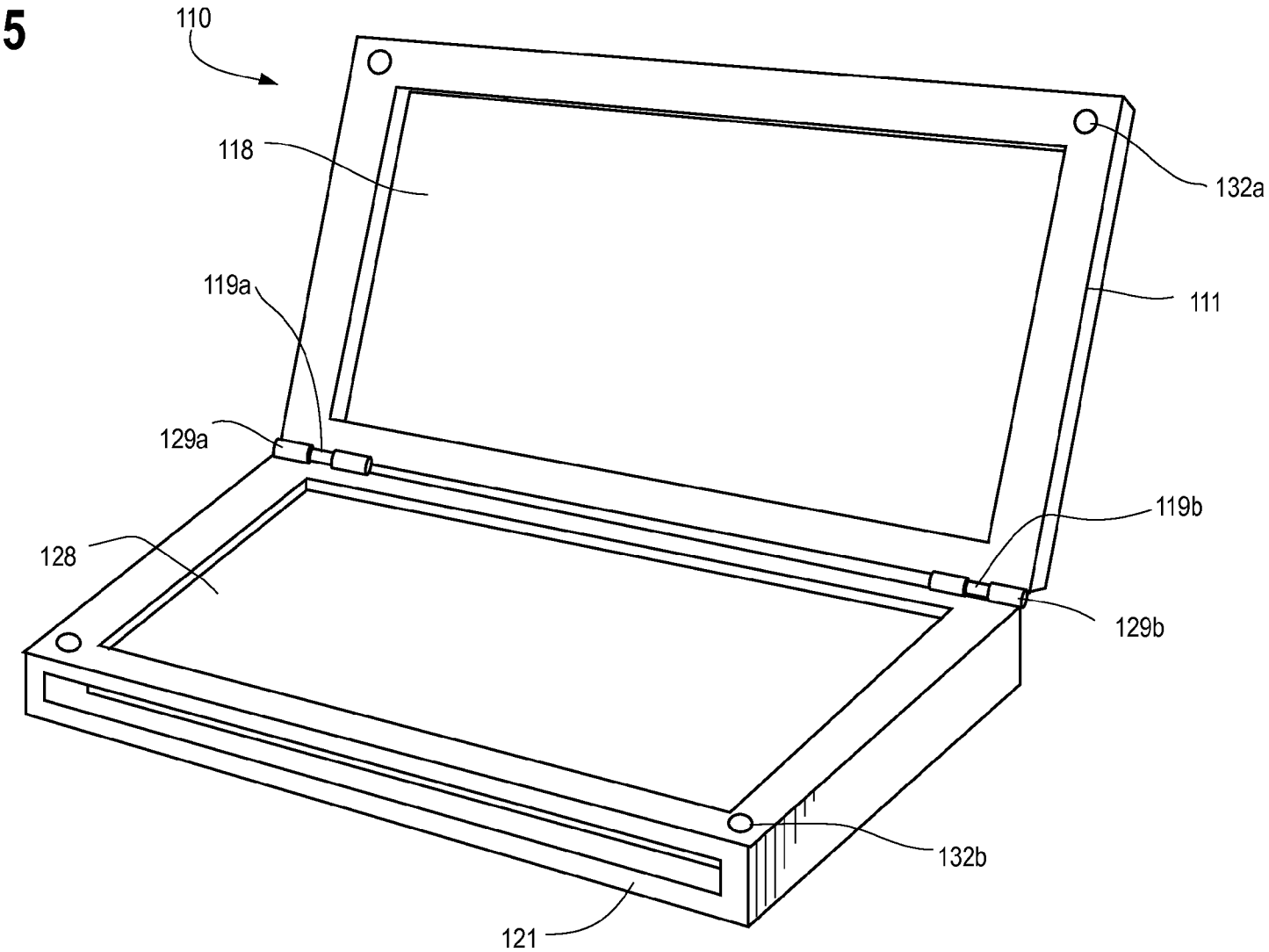
FIG. 5 is a perspective view of the clutch case embodiment of FIG. 4 in the open position.

As shown in FIG. 5, when clamshell members 111, 121 are open, access is provided to the interior chamber defined by the combined spaces 118, 128. FIG. 5 also shows the relative locations of hinge tabs 119*a*, 129*a* and 119*b*, 129*b*, which are held together by a pin that is press fitted through the tabs. Magnetic closures 132*a*, 132*b* cooperate to hold clamshell members 111, 121 in the closed position.

Figure 6:
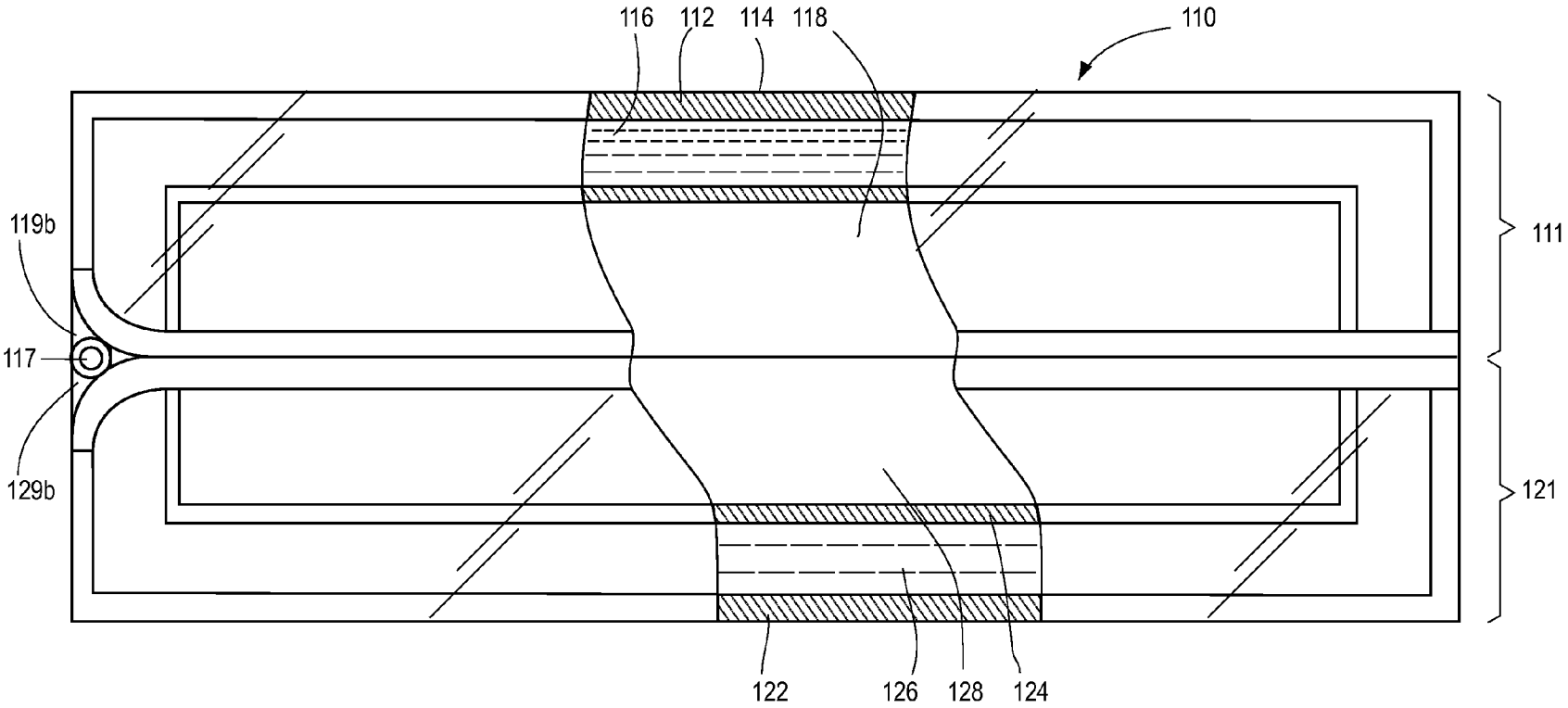
FIG. 6 is a side elevation view, partially in cross-section, of the clutch case embodiment of FIGS. 4 and 5 in the closed position.

FIG. 6 is a side elevation view of the clutch case 110 in the closed position. As in FIG. 4, clutch case 110 includes clamshell members 111, 121 hinged together at a bottom edge thereof. Clamshell member 111 includes an exterior shell 112 and an interior shell 114 configured such that a lumen 116 is formed between exterior shell 112 and interior shell 114. A space 118 is defined at the interior side of interior shell 114. Clamshell member 121 includes an exterior shell 122 and an interior shell 124 configured such that a lumen 126 is formed between exterior shell 122 and interior shell 124. A space 128 is defined at the interior side of interior shell 124. Clamshell members 111, 121 are hinged together on one end by cooperating hinge tabs 119*b*, 129*b*, which have a pin 117 extending through the tabs to form a hinge.

Figure 7:
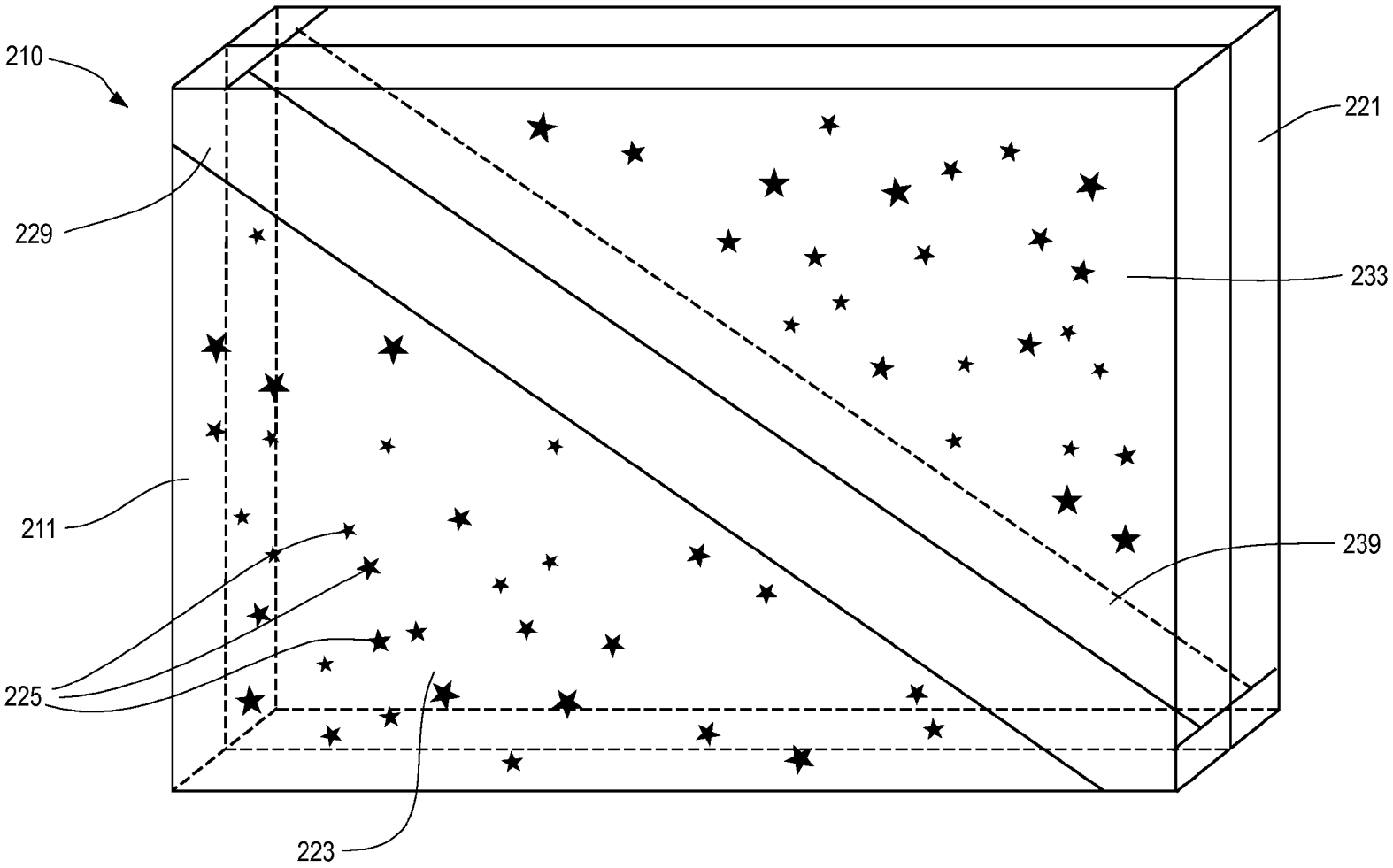
FIG. 7 is a perspective view of a third embodiment of a clutch case with integral lumens, having a design substantially similar to that of FIG. 1, with solid bars extending between portions of the side walls to divide the interior chamber into a plurality of minor interior chambers and which also interrupts the lumens to define a plurality of minor lumens.

FIG. 7 is a perspective view of a third embodiment of a clutch case 210 formed by a pair of clamshell members 211, 221 with integral lumens for containing a liquid with entrained decorative material 225, shown in the closed position. Solid bars 229, 239 extend between portions of the side walls of clamshell member 221, 231, respectively, to divide the interior chamber into a plurality of minor interior chambers 223, 233 and which also interrupt the lumens to define a plurality of minor lumens.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A clutch case comprising a pair of clamshell members hinged together at a bottom edge thereof such that said members when closed form an interior chamber for containing objects and when open provide access to said interior chamber, wherein each of said clamshell members is formed of nonflexible material having an exterior shell and an interior shell which is configured to form a hollowed-out interior portion, thereby defining an interior lumen extending along at least a portion of its perimeter, said lumen containing a liquid having decorative material entrained therein, wherein each of said clamshell members comprises a major planar surface and side walls extending perpendicularly from said surface toward the other of said clamshell members, wherein at least one solid bar extends between portions of said side walls to divide said interior chamber into a plurality of minor interior chambers, and whereby tilting said case imparts motion to said entrained decorative material to create a unique visual appearance.

2. The clutch case of claim 1, further comprising a clasp for retaining said clamshell members in a joined position such that said objects are securely retained within said interior chamber.

3. The clutch case of claim 2, wherein said clasp resembles a jewel.

4. The clutch case of claim 2, wherein said clasp is mounted on one of said clamshell members by a hinge, said clasp detachably securable to a retaining member mounted on the other of said clamshell members, said clasp maintained in a normally closed position by a resilient member interposed between said clasp and said one of said clamshell members.

5. The clutch case of claim 4, wherein said resilient member is a spring.

6. The clutch case of claim 1, wherein said at least one solid bar interrupts said lumen to define a plurality of minor lumens.

7. The clutch case of claim 6, wherein each of said minor lumens contains a liquid having different decorative materials entrained therein.

8. The clutch case of claim 1, wherein said clamshell members are formed from a transparent material.

9. The clutch case of claim 8, wherein said interior chamber accommodates an image mounted therein such that said image is viewable from the exterior of said clutch case.

10. The clutch case of claim 9, wherein said image is a photograph.

11. The clutch case of claim 9, wherein said image is press-fitted in said interior chamber.

12. The clutch case of claim 1, wherein said decorative material comprises solid particles.

13. The clutch case of claim 12, wherein said solid particles are colored such that said particles are contrasting in appearance with objects contained within said interior chamber.

14. The clutch case of claim 13, wherein said solid particles are colored white such that motion imparted to said particles creates a snowglobe-like appearance.

15. The clutch case of claim 1, wherein said decorative material comprises a fluid having a viscosity different from that of said liquid, said fluid colored such that said fluid contrasts in appearance with said liquid and when coagulated creates a lava-like appearance.

16. The clutch case of claim 1, further comprising a pair of magnetic closures for retaining said clamshell members in a joined position such that said objects are securely retained within said interior chamber.

* * * * *